United States Patent [19]

Beer et al.

[11] Patent Number: 4,617,912

[45] Date of Patent: Oct. 21, 1986

[54] INCUBATOR

[75] Inventors: Christian Beer, Boniswil; Robert Riedweg, Luzern; Klaus Schlensog, Cham, all of Switzerland

[73] Assignee: Ameda AG, Zug, Switzerland

[21] Appl. No.: 732,291

[22] Filed: May 9, 1985

[30] Foreign Application Priority Data

May 18, 1984 [CH] Switzerland ..... 2453/84

[51] Int. Cl.[4] ..... A61G 11/00

[52] U.S. Cl. ..... 128/1 B; 34/219; 34/225

[58] Field of Search ..... 128/1 B, 205.26; 119/15, 160; 34/219, 225

[56] References Cited

U.S. PATENT DOCUMENTS 3,668,817 6/1972 Bell ..... 34/225
3,821,947 7/1974 Schossow ..... 128/113
4,361,137 11/1982 Grosholz ..... 128/113

FOREIGN PATENT DOCUMENTS 6508219 12/1965 Netherlands ..... 128/1 B

*Primary Examiner*—Henry J. Recla
*Attorney, Agent, or Firm*—Holman & Stern

[57] ABSTRACT

An incubator for neonatology has a chamber to receive a baby and to maintain it under aerated and heat-controlled conditions; the chamber is enclosed by a bottom shell and a transparent topy casing; heating and aerating means as well as an air distribution system are provided; passage of heat-controlled air through the chamber is optimized by a pair of superimposed horizontal trays that define two air-conducting spaces, one between the lower tray and the bottom shell and the other between the lower and the upper tray; the upper tray includes an insert that supports the baby; the lower tray is about as long as the chamber; the upper tray is shorter but less wide than the chamber; longitudinal air-passing gaps are formed between the lower tray and the bottom shell and communicate with the lower air-conducting space; transverse air-passing gaps are formed between adjacent end walls of the trays and communicate with the upper air-conducting space.

The suction side of a blower is connected with one of the air-conducting spaces while the blowing side is connected with the other. When the blower is operated, two pairs of air curtains are formed, one pair by the two transverse gaps and the other pair by the two longitudinal gaps. One curtain pair is up-current, the other is down-current for passing heated air smoothly and draft-free through the chamber.

The two interfitting trays provide a novel and effective air distribution system for incubators and similar devices, yet can be removed and reassembled easily for thorough disinfection between changes of patients.

10 Claims, 5 Drawing Figures

INCUBATOR

BACKGROUND OF THE INVENTION

This invention relates to incubators for neonatology of the type known and used for intensive care of newborns afflicted by abnormally low weight or other defects due to premature birth, incomplete development, sickness, malformation and other pathological conditions of newborns.

In essence, incubators are aerated and heat-controlled (e.g. 38° C.±0.5° C.) chambers formed by a generally elongated rectangular bottom shell and a transparent top or cover casing normally provided with a number of circular ports connected with the open ends of rubber gloves or similar membrane-type closures providing for sterile handling of the baby.

Generally, the top casing of an incubator can be removed from the bottom shell, e.g. by pivoting, and the front wall of the casing is pivotable as well for removing or inserting the patient.

When the incubator chamber is in operating position, air or oxygen-enriched air heated to constant temperature is passed through the chamber to maintain the baby at optimum ambient conditions; humidification by evaporators, atomizers, etc. is conventional.

Prior art incubators suffer from a number of defects, however, notably as regards lack of uniform airflow; this causes an undesirable temperature distribution because the air that is circulated or passed through the chamber is also the medium that heats the chamber so that an inhomogeneous air distribution leads to non-uniform heat distribution.

At the same time, conventional air-guiding means in prior art incubators, such as vanes, perforated panels, and grids, are disadvantageous in view of sterility because they are difficult to clean and tend to promote accumulations of airborne infection sources; in addition, the air distribution means of conventional incubators tend to be bulky or complicated which, in turn, makes the incubators expensive, both as regards manufacture and maintenance.

BRIEF SUMMARY OF THE INVENTION

Accordingly, it is a main object of the present invention to provide for an incubator that is free of the above disadvantages and combines the advantages of a smooth and uniform airflow that is draft-free, i.e. essentially laminar, with an extremely simple yet effective construction of novel and improved air-guiding means.

A further object of the invention is to provide for an incubator in which the air-guiding means are formed by only a few and smooth-surfaced components that can be easily mounted for assembly and easily dismounted for cleaning and disinfection.

Yet a further object of the invention is to provide for the above mentioned advantages in a relatively compact incubator that can be manufactured and operated economically.

Further objects will become apparent as this specification proceeds.

The above objects are achieved according to the invention by an incubator of the type having: a chamber substantially defined or enclosed by a bottom shell and a transparent top casing or hood, both of which may be of conventional structure; a heating and aerating means, such as a motor-driven blower plus heating elements; and an air distribution means for passing a stream of heated air through said chamber; the incubator according to the invention is characterized by a novel and improved construction of the air distribution means comprising two superimposed trays having a number of essential or preferred features as explained in more detail below.

The transparent top casing (also termed "hood" for brevity) of the incubator has a generally box-like shape and covers a substantially rectangular area of the bottom shell; because of the patient's body shape the rectangular area is elongated, i.e. its length is greater than its width, e.g. by a factor of 1.2 to 2. Width and height dimensions of the hood may be about equal; typically, the width:height ratio of the hood is in the range of from 0.8 to 1.2, this being a matter of choice. The width and length dimensions of the hood-covered rectangular area of the bottom shell are essential parameters for the trays, however.

Generally, the bottom shell will be shaped to form recesses for receiving a ventilator or blower plus heating means and evaporators, and may have passages for air inlets and the like conventional means for operating an incubator; preferably, the line of contact between the hood and the bottom shell will be in a horizontal plane defined, for example, by the lower edge of the top casing and a corresponding support area of the bottom shell. The bottom shell may be an integral or a composite structure of two or more shell portions.

According to the invention, the incubator chamber includes a pair of superimposed and substantially rectangular trays, the lower of which will also be termed "first tray" or "air-guiding tray" because its primary function is to guide the aeration stream or air flow before its passage into the chamber and after its passage through the chamber. "Passage" of air through the chamber is understood to include partial or substantial recirculation.

The upper tray is also called "second tray" or "support tray" since this tray also serves to hold a generally flat layer of a relatively soft material which, in turn, supports the baby.

As used herein, the term "tray" generally refers to structures having a generally flat bottom which when in normal operating position extends substantially in a horizontal direction, and further having two mutually opposed longitudinal side walls and two mutually opposed transverse end walls that are shorter than the longitudinal side walls of the trays.

When a tray is in normal operating position, side and end walls will extend upwards from the bottom.

According to the invention, the lower or first and the upper or supporting tray are arranged with their bottoms in a generally parallel and distanced (typically from 10 to 150 mm) relation when in normal operating position. However, the incubator may include mechanical or pneumatic positioning means for elevating the head end or/and the foot end of the support tray so that the patient may be held in an inclined (typically up to 20°) position "head up" or "head down".

Further, for removal of the patient when the top casing or its lid is in "open" position, the upper or support tray will preferably be mounted on slide rails or the like means so that this tray may be slidingly moved from its normal operating position within the chamber into a charge or discharge position outside of the chamber.

According to an essential feature of the invention, the first or lower tray will have substantially the same length as the hood-covered rectangular area of the bottom shell; in other words, the lower tray will be substantially as long as the inner length of the top casing; typically, the difference between length of the lower tray and the (inner) length of the transparent top casing will be in the range of from 5 to 20 mm.

The upper tray is shorter than the lower tray, typically by 40 to 400 mm, but wider than the latter, typically by 30 to 300 mm. The upper tray is wider than the lower tray but not as wide as the hood-covered rectangular bottom shell area; typically, this difference between the width of the hood-covered shell area and the width of the upper tray will be in the range of from 20 to 200 mm.

Further, according to an essential feature of the invention, the lower or air-guiding tray separates two air-conducting spaces: the lower or first of these spaces is formed between the bottom shell and the lower tray; the upper or second air-conducting space is formed between lower and upper tray.

Preferably, the upper or second air-conducting space is formed essentially by the interspace between upper and lower tray while the lower air-conducting space is formed essentially by a generally rectangular interspace between the lower tray and a substantially rectangular recessed portion of the bottom shell; preferably, this recessed portion of the bottom shell is somewhat shorter, typically by 25 to 250 mm, than the lower tray, but somewhat wider than the latter, typically by 20 to 200 mm.

According to the invention, a pair of longitudinal air gaps is formed between the lower tray and the bottom shell; each of these gaps communicates with the first or lower air-conducting space and extends over a predominant portion, at least, typically over more than 50% and preferably over at least about 70%, of the length of the (inner) sides of the top casing, i.e. the length of the rectangular bottom shell area covered by the top casing.

Further, according to the invention, a pair of transverse air-passing gaps is formed between the end walls of the upper tray and the lower tray; each transverse gap communicates with the second air-conducting space and extends over a major portion, at least, typically about 30% and generally at least about 50%, of the width of the rectangular bottom shell area.

Finally, an air blower of the type known per se, e.g. a radial blower, is provided such that its blowing end opens into one air-conducting space while its suction end opens into the other air-conducting space; preferably, the blowing end of the blower opens into the first or lower air-conducting space while the suction, end is connected with, or acts upon, the upper air-conducting space. In this preferred embodiment, the bottom of the upper tray is substantially closed while the bottom of the lower tray has an opening, preferably at or near its geometric center, leading via a short conduit to the suction end of the blower.

BRIEF DESCRIPTION OF THE DRAWINGS

The invention will be better understood and objects other than those set forth above will become apparent when consideration is given to the following detailed description thereof. Such description makes reference to the annexed drawings which illustrate preferred exemplary embodiments of the invention and wherein.

BRIEF DESCRIPTION OF THE PREFERRED EMBODIMENTS

Figure 1A:
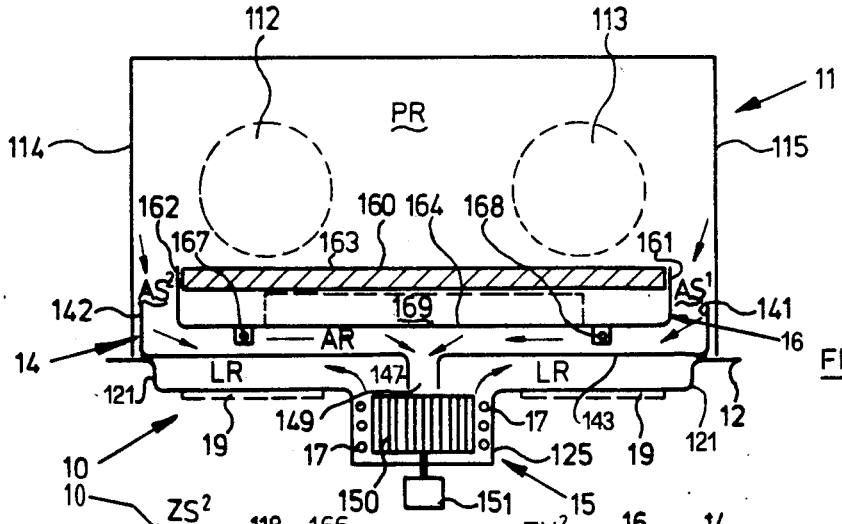
FIG. 1*a* is a side view of a diagrammatic presentation of an incubator according to the invention.
Figure 1B:
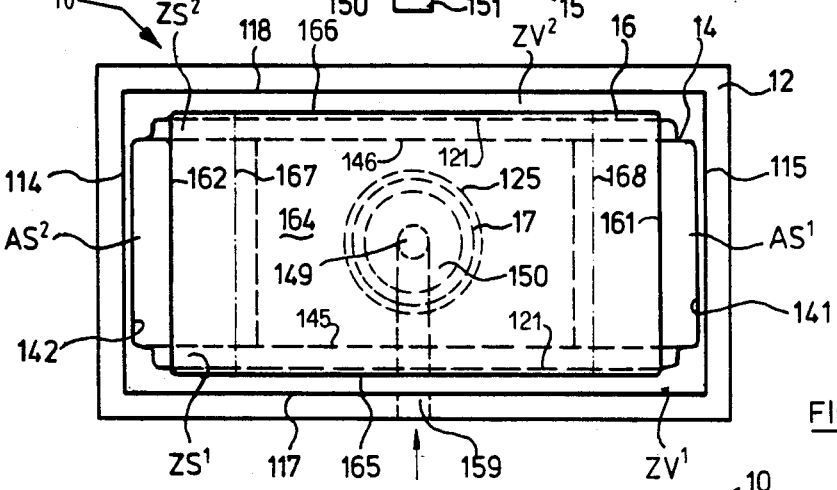
FIG. 1*b* is a top view of the incubator shown in FIG. 1*a*.
Figure 1C:
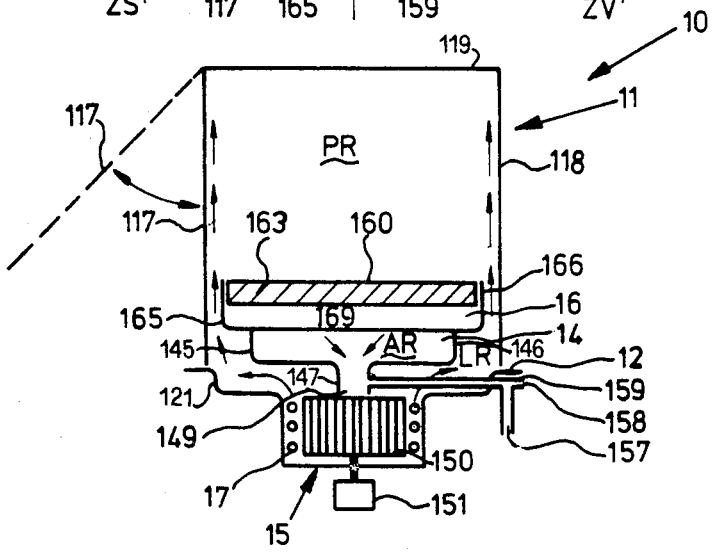
FIG. 1*c* is a front view of the incubator shown in FIG. 1*a*.

Describing now the drawings, the incubator 10 which is illustrated diagrammatically in FIG. 1*a* in side view comprises a transparent top casing 11 made of a transparent plastic or glass and being provided in a conventional manner with pivoting or securing means (not shown) for connecting the top casing 11 with, and disconnecting it from bottom shell 12; one longitudinal side wall may be pivotably connected with the top casing as shown in broken lines for side wall 117 in FIG. 1*c* and the hinge may be either near a top edge or a bottom edge of casing 11.

Casing 11 further comprises a number of conventional circular ports, e.g. a total of six, only two being shown as ports 112, 113 in broken lines. Each such port will be closed with a membrane, e.g. in the form of a glove, to permit sterile handling of the patient within incubator 10. Additional smaller ports with overlapping membranes can be provided in a conventional manner to permit passage of conduits or leads for infusion or monitoring. Sealing joints between the port openings of top casing 11 and the membranes are conventional and not shown.

The lower edges of transverse end walls 114, 115 and of longitudinal side walls 117, 118 (FIG. 1*b*) contact bottom shell 12, generally without an intermediate seal. Bottom shell 12 can be made of metal, e.g. steel sheet which may be of stainless quality or is provided with a coating, or of plastic, e.g. fiber-reinforced thermoset polyester or epoxy resin; shell 12 has a first recessed portion 121 that cooperates with bottom 143 of lower tray 14 to form the first air-conducting space LR. A second recessed portion 125 of bottom shell 12 forms an open-ended chamber for receiving a blower 15 comprising a rotor 150 driven by a motor 151 which, in turn, is connected by means of an anti-vibration socket (not shown) or the like means that minimize vibration. Rotor 150 is formed in a conventional manner by a number of outwardly slanted blades mounted between a closed lower rotor disc and an annular upper rotor disc; a space free of blades is provided at the center of the rotor.

When motor 151 drives rotor 150, the rotating blades will cause a suction effect at the rotor center and a blowing effect at the rotor periphery.

Electrical heating elements 17 are provided between the periphery of rotor 150 and the adjacent wall of chamber 125 so that the air passing from rotor 150 will be heated. Control means for the heating elements 17 are conventional and not shown.

The lower tray 14, e.g. made of a molded plastic of the thermoplastic or the crosslinked family, with or without fiber reinforcement, is formed by two transverse end walls 141, 142, two longitudinal side walls 145, 146 and bottom 143 which, in turn, is substantially closed except that an opening 149 is provided near its geometrical center with a tubular extension or conduit 147 extending through the first air-conducting space LR to the suction end of rotor 150.

Upper tray 16 is formed by two transverse end walls 161, 162, two longitudinal side walls 165, 166 and bottom 164; tray 16 is supported by two guides 167, 168 for sliding motion along two rails or rods (not shown) connected to the lower tray 14 so that upper tray 16 can be displaced horizontally relative to lower tray 14 when lid 117 of top casing 11 is opened.

A drawer-type insert 169 (shown in broken lines) is provided to receive X-ray film material to permit taking X-ray photographs of the patient within the incubator. A resilient pad 163 is inserted into tray 16 to serve as support face 160 for the patient.

Lower tray 14, the air-guiding tray, is supported near its end walls 141, 142 by bottom shell 12 within the substantially rectangular area of bottom shell 12 covered by top casing 11. As will be seen from FIG. 1*a* and 1*b*, tray 14 has almost the same length as the casing-covered area of bottom shell 12. Upper tray 16 is shorter but wider than lower tray 14.

Figure 1D:
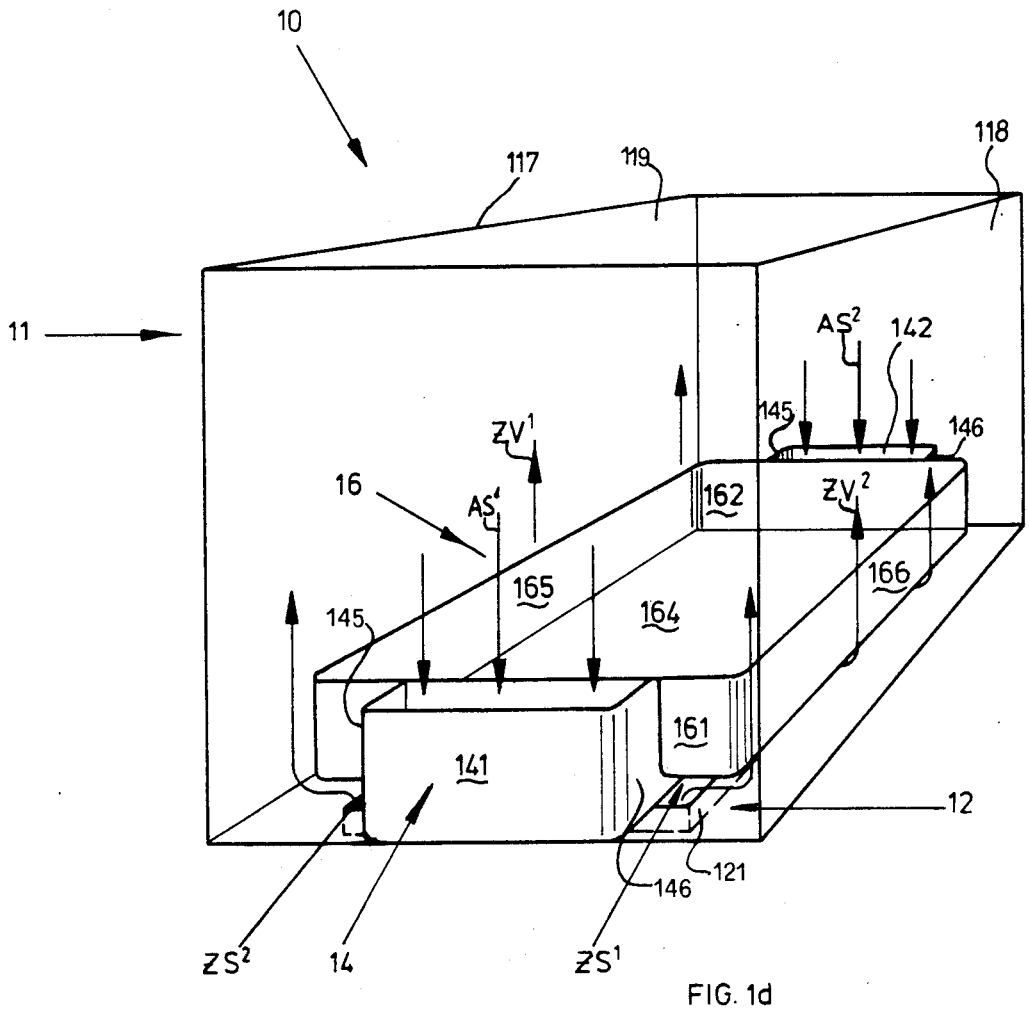
FIG. 1*d* is a perspective view of a diagrammatic representation of two interfitting trays as arranged within an incubator according to the invention.

As best seen from FIG. 1*d*, the recessed portion 121 of bottom shell 12 is wider than lower tray 14 but shorter than the latter so that two longitudinal air-passing gaps $ZS^1$, $ZS^2$ are formed between bottom shell 12 and lower tray 14.

Two transverse air-passing gaps $AS^1$, $AS^2$ are formed between end walls 141, 161 and 142, 162 of lower tray 14 and upper tray 16. The longitudinal air-passing gaps $ZS^1$, $ZS^2$ extend almost over the entire length (e.g. about 85 to 95%) of the casing-covered area of bottom shell 12 while transverse air-passing gaps $AS^1$, $AS^2$ extend over a major portion (e.g. about 40 to 70%) of the casing-covered area of bottom shell 12.

Returning to FIG. 1*a*, 1*c* it will be seen that a first or lower air-conducting space LR is formed between bottom shell 12, e.g. the recessed portion 121 thereof, and lower tray 14; a second or upper air-conducting space AR is formed between lower tray 14 and upper tray 16. Both air-conducting spaces have a generally flat configuration, i.e. their height is substantially smaller than either their width or their length; in top view,, these air-conducting spaces will have a generally rectangular shape.

The general function of the air-conducting spaces and notably the one (LR in the preferred embodiment) that opens into the longitudinal air-passing gaps ($ZS^1$, $ZS^2$) is to provide for a smooth and even flow of the air that usually has a certain turbulence near the blower; in other words, the air-conducting spaces serve as flow buffers between the unavoidable turbulence in the vicinity of the blower and the desired smooth or substantially laminar flow at the air-passing gaps, notably at those air-passing gaps where the air stream enters into the chamber space PR ($ZS^1$ and $ZS^2$ in FIG. 1*b* and 1*c*).

Following the air stream from blower rotor 150 through heating elements 17 into the first air-conducting space LR through the longitudinal air-passing gaps $ZS^1$, $ZS^2$ it will be seen (FIG. 1*d*) that two up-current air curtains $ZV^1$, $ZV^2$ will pass between the side walls 165, 166 of upper tray 16 and the adjacent side walls 117, 118 of top casing 11 so as to cover these major walls of the top casing with a dynamic insulation while passing the heated air essentially free of draft and turbulence into the chamber space PR.

The up-stream air curtains will converge at the inner surface of top wall 119 and then become divided again into two downcurrent streams that cover a major part of the inner surfaces of end walls 114, 115 of top casing 11 and then pass out of chamber space PR via the two transverse gaps $AS^1$, $AS^2$ formed between the end walls 141, 161 and 142, 162 of trays 14, 16.

After passing through the transverse air-passing gaps, the air streams will now pass into air-conducting space AR and converge near its center where opening 149 extends via conduit 147 to the suction end of blower 15.

Fresh air is allowed to enter into conduit 147 via conduit 159 supplied with a control valve (not shown); an optional branch conduit 157 is provided to supply pure oxygen if the air passed into the chamber is to contain an increased oxygen level. Conventional air filters may be provided at 158 in conduits 157; humidifier layers 19 (shown in broken lines in FIG. 1*a*) supplied with water from a conduit (not shown) may be arranged and operated as required.

Figure 2:
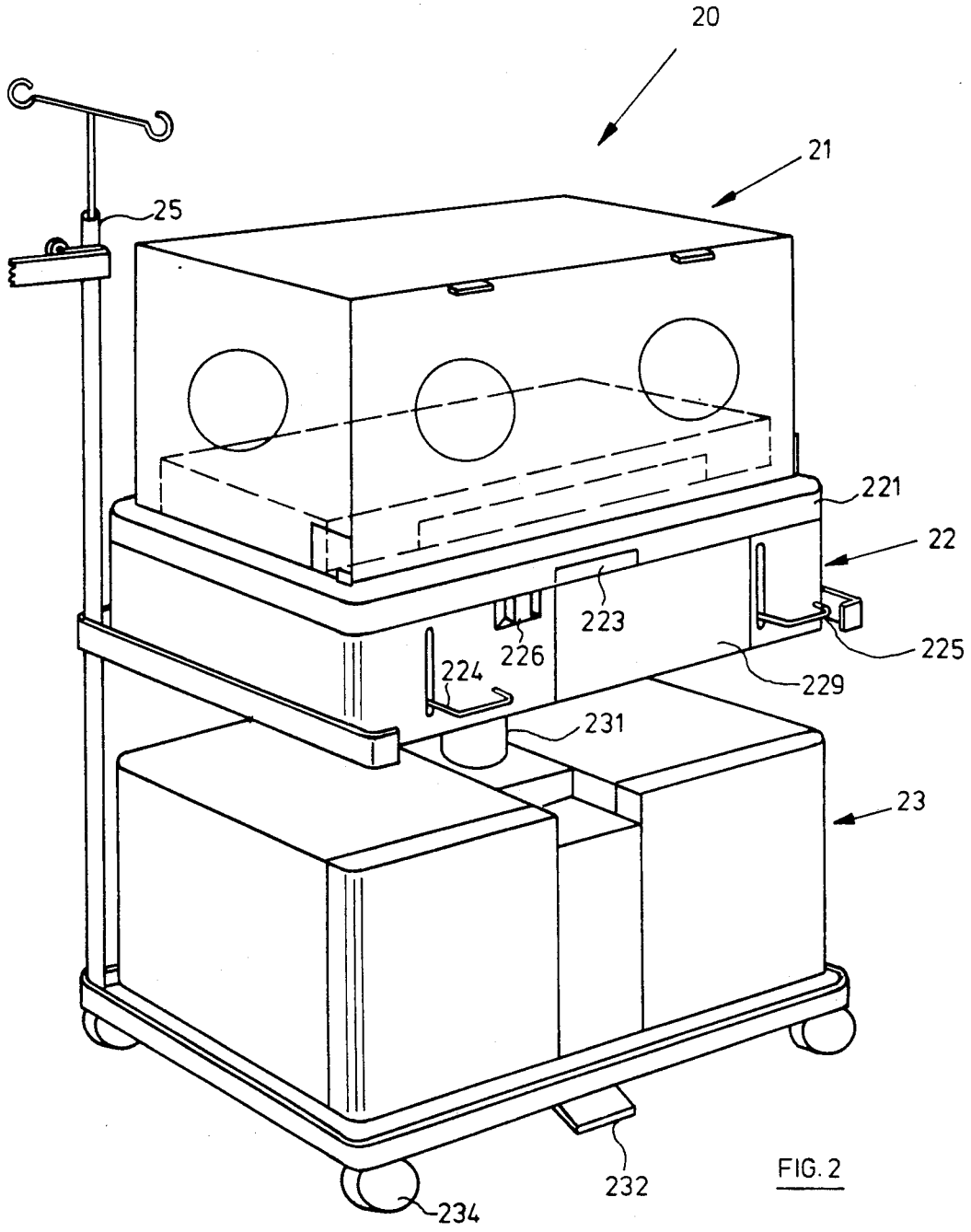
FIG. 2 is a semi-diagrammatic perspective view of an inventive incubator mounted on a movable support structure.

FIG. 2 shows a simplified perspective view of an incubator 20 according to the invention including a transparent top casing 21 upon bottom shell 221 which, in turn, is the upper closure of a central service portion 22 that comprises a main panel 229 (details not shown) for all parameters and data including monitoring, control and operation, an air entry port 223 and a water conduit 226; two handles 224, 225 are provided for lifting the foot end or the head end of the upper tray that carries the patient support; a weight-compensated mechanism (not shown) may serve to provide for a non-jolting change of position.

Because intensive care of baby patients may require long periods of continuous manipulation, it is desirable to provide for a lifting device so that the height position of incubator 20 may be adapted, e.g. via plunger 231, to the requirements of surgeons and nurses; to this end, the lower chassis portion 23 may be provided with a foot-controlled switch; rollers 234 are arranged for mobility of the unit and a "christmas tree" 25 is attached to support containers for infusion or transfusion liquids and auxiliary devices as needed.

Returning to the inventive incubator structure illustrated in FIG. 1*a* to 1*d* it should be added that tests made with such incubators have shown that with fresh air feeding rates of e.g. 25 liters per minute and with five measuring points distributed over the patient support suface, a maximum deviation of 0.5° C. could be maintained at temperature settings of from 35° to 39° C. without problems; low noise levels of 30 to 50 phon were obtained because of the smooth air flow.

Generally, trays 14, 16 should have rounded edges where possible to provide smooth flow and easy cleaning, and suitable integral structures may be obtained by molding or deep drawing of conventional polymer material; suitable materials for the trays and other components should be resistant to normal disinfection.

Various modifications of the inventive incubator will be apparent on the basis of the above specification. For example, the bottom shell 12 may consist of two complemental portions such that the control panel 229 can be withdrawn together with motor 151 and blower 15 to facilitate maintenance and repair.

Control of $CO_2$ can be achieved in a conventional manner and without particular removal means simply by means of fresh air supply rates of between 10 and 40 liters per minute; a typical incubator volume of 100 to 400 liters will ascertain that carbon dioxide is removed together with the surplus air; positive chamber pressures of 5 to 20 cm of water column are suitable for many purposes.

It will be noted that the preferred interfitting tray arrangement illustrated in FIG. 1*d* provides for optimum compactness of the novel air distribution means and, hence, an inventive incubator.

For a substantially complete interfit of the superimposed trays, the height of end walls 141, 142 of tray 14 will be greater than the height of end walls 161, 162, the height difference being determined by the desired "thickness" or height of the second or upper air distribution space; the longitudinal side walls 145, 146 of tray 14 will have a first portion where their height is the same as that of end walls 141, 142 and a second portion where they are recessed or "lowered" substantially by the height of side walls 165, 166 so as to receive tray 16 in a flush arrangement of all tray walls; a perfect flush is not critical, however, and non-flushing arrangements (FIG. 1*a*) may still be interfitting as long as the side walls of the lower tray have some recess, at least, to receive a portion, at least, of the height of the upper tray.

While there are shown and described present preferred embodiments of the invention, it is to be understood that the invention is not limited thereto but may be embodied and practiced within the scope of the following claims.

Accordingly what is claimed is:

1. An incubator for neonatology comprising a chamber substantially enclosed by a transparent top casing having two longitudinal side walls and two transverse end walls in a substantially rectangular arrangement and a bottom shell for supporting said top casing comprising a generally rectangular recess having a bottom face and two longitudinal sides;

heating and aerating means, and air distribution means for passing a stream of heated air through said chamber;

said top casing covering a substantially reactangular area of said bottom shell and said area having a length and a width;

said chamber including a pair of superimposed substantially rectangular trays;

each of said trays having two longitudinal walls, two transverse end walls, and a bottom wall;

said trays being arranged with their bottom walls in a generally parallel and distanced relation when in normal operating condition; the lower of said trays having substantially the same length as said rectangular bottom shell area and a width smaller than said rectangular bottom shell area;

the upper of said trays being shorter and wider than said lower tray but having a width smaller than said rectangular bottom shell area;

a first air-conducting space formed between said bottom face of said recess and said bottom wall of said lower tray, and a second air-conducting space formed between said bottom wall of said lower tray and said bottom wall of said upper tray;

a pair of air-passing longitudinal gaps formed between said lower tray and said longitudinal sides of said recess, each of said longitudinal gaps communicating with said first air-conducting space and extending over a predominant portion, at least, of said length of said rectangular bottom shell area at each of said side walls of said lower tray;

and a pair of transverse air-passing gaps formed between said end walls of said upper tray and said lower tray, each of said transverse gaps communicating with said second air-conducting space and extending over a major portion, at least, of said width of said rectangular bottom shell area;

said aerating means comprising a blower having a suction end and a blowing end, said blowing end being connected with one of said air-conducting spaces and said suction and being connected with the other of said air-conducting spaces.

2. The incubator of claim 1, wherein said blowing end of said blower opens into said first air-conducting space and wherein said lower tray has an opening provided with a conduit that extends from said second air-conducting space to said suction end of said blower.

3. The incubator of claim 1, wherein said upper tray comprises guide means for horizontal displacement of said upper tray relative to said lower tray and out of said chamber when a lid portion of said transparent top casing is opened.

4. The incubator of claim 2, wherein a humidifier surface is provided within said first air-conducting space.

5. The incubator of claim 2, wherein said blower is a radial blower and wherein said bottom shell includes a chamber for receiving and enclosing said radial blower, and a means for heating air that is passed through said chamber by said blower.

6. The incubator of claim 1, wherein said upper tray is made of a material that is substantially non-absorbent for Xrays and includes a recess for receiving and holding an X-ray film material.

7. The incubator of claim 1, wherein said longitudinal side walls of said lower tray each have a recess for receiving said upper tray in an interfitting relation so as to form said second air-conducting space and said transverse gaps between said lower and said upper tray.

8. The incubator of claim 7, wherein said lower and said upper tray form an easily dismountable assembly for separate disinfection of said trays.

9. The incubator of claim 7, wherein said air-guiding tray and said upper tray are each formed by an integrally molded structure.

10. The incubator of claim 1, wherein said upper tray includes a flat pad of a soft material suitable for use as a patient support surface.

* * * * *